United States Patent [19]

Camacho

[11] 4,383,820

[45] May 17, 1983

[54] FUEL GAS BURNER AND METHOD OF PRODUCING A SHORT FLAME

[75] Inventor: Salvador L. Camacho, Raleigh, N.C.

[73] Assignee: Technology Application Services Corporation, Raleigh, N.C.

[21] Appl. No.: 195,779

[22] Filed: Oct. 10, 1980

[51] Int. Cl.[3] ..... F23C 5/00; F23Q 3/00

[52] U.S. Cl. ..... 431/8; 431/183; 431/187; 431/265; 126/110 C; 239/406

[58] Field of Search ..... 431/171, 8, 183, 112, 431/187, 284, 285, 353, 265; 239/405, 406, 478, 112, 113; 126/116 R, 116 A, 110 C

[56] References Cited

U.S. PATENT DOCUMENTS

| | | | |
|---|---|---|---|
| 2,585,081 | 2/1952 | Bernhard | 431/265 X |
| 2,821,246 | 1/1958 | Ide et al. | 431/284 X |
| 2,898,980 | 8/1959 | O'Cathey et al. | 158/109 |
| 2,976,919 | 3/1961 | Sanborn | 158/76 |
| 3,079,981 | 3/1963 | Loebel et al. | 158/28 |
| 3,152,635 | 10/1964 | Cox et al. | 158/109 |
| 3,258,057 | 6/1966 | Keyes et al. | 158/76 |
| 3,279,705 | 10/1966 | Stiefel | 239/490 |
| 3,469,790 | 9/1969 | Duncan | 239/402.5 |
| 3,523,004 | 8/1970 | Mellett et al. | 126/116 R X |
| 3,689,040 | 9/1972 | Reich | 431/353 X |
| 4,201,539 | 5/1980 | Voorheis | 431/354 |

FOREIGN PATENT DOCUMENTS

| | | | |
|---|---|---|---|
| 2202913 | 8/1972 | Fed. Rep. of Germany | 431/183 |
| 2324104 | 11/1974 | Fed. Rep. of Germany | 431/353 |
| 1537037 | 12/1978 | United Kingdom | 431/265 |

*Primary Examiner*—Samuel Scott
*Assistant Examiner*—Randall L. Green
*Attorney, Agent, or Firm*—B. B. Olive

[57] ABSTRACT

A fuel gas burner produces a short fan-shaped flame and has primary utility in oil-to-gas furnace conversions. The burner includes swirl generating blades disposed in an annulus between a burner barrel carrying the bulk of the combustion gas and a mixing tube carrying approximately a 1.1 air/gas mixture. The blades induce a violent, turbulent action to the combustion gas to encourage formation of the short flame. The flame is preferably formed with a fan shape.

3 Claims, 8 Drawing Figures

FUEL GAS BURNER AND METHOD OF PRODUCING A SHORT FLAME

DESCRIPTION

1. Technical Field

The present invention relates to fuel gas burners, more particularly, to gas burners producing short flames and having primary utility in the conversion of oil-fired furnaces to gas-fired furnaces.

2. Background Art

In many furnace applications it is desirable to have a burner which will produce a relatively short flame. This is particularly true in the conversion of oil-fired furnaces to gas-fired furnaces. Oil burning furnaces for residential and light commercial applications typically have a relatively short firebox on the order of two to three feet. The flame from the oil burner associated with such furnaces is, therefore, a relatively short flame to accommodate the firebox.

A problem associated with the conversion of such an oil-fired furnace to one which will be fired by fuel gas is that the flame emanating from a conventional gas nozzle is quite long, often on the order of six feet. It is necessary for a proper conversion that the effective length of the gas flame be reduced to approximate the length of the flame from the oil-fired burner being replaced.

Prior techniques for reducing the length of gas flames have included the use of mechanical deflectors or cantilevered flame spreaders. Such mechanical devices have the disadvantage of having to withstand continuous exposure to the flame.

It has become desirable to provide a fuel gas burner, particularly for oil-to-gas furnace conversions, which will present a relatively short flame utilizing only aerodynamic means of flame length reduction.

DISCLOSURE OF INVENTION

In accordance with the present invention there is provided a fuel gas burner comprising a source of air for combustion; a gas inlet valve for connection to a source of fuel gas; means for igniting the fuel gas at a combustion zone; control logic circuitry for controlling said inlet valve and means for igniting; a tubular gas supply conduit for carrying fuel gas from the gas inlet valve; means defining a nozzle at the end of said gas conduit; a gas/air mixing tube surrounding an end portion of said gas conduit and extending downstream a predetermined distance beyond said nozzle and mounting a deflector at its downstream end, said mixing tube and gas conduit defining therebetween an annulus for receiving a portion of the combustion air emanating from said source of air, the air so received mixing with gas emanating from said nozzle to facilitate transfer of gas from the nozzle to the downstream end of the mixing tube; a burner barrel having an upstream end in communication with said source of air, said burner barrel surrounding said mixing tube to define a second annulus for carrying the remainder of the combustion air; a swirl generator disposed in said outer annulus upstream from said deflector, said swirl generator being secured to said mixing tube and comprising a plurality of swirl blades disposed at an angle X less than 90° to the path of combustion air in the second annulus to generate turbulence in such air prior to its mixture with the air/gas emanating from said mixing tube, the perimeter of the swirl blades being sized to engage the inner surface of the burner barrel to hold the downstream end of the mixing tube in place, and an annular gap provided at the securement of the swirl generator to the mixing tube to provide a stream of air for sweeping the air/gas mixture emanating from the mixing tube away from the downstream side of the swirl blades.

In another aspect, the invention provides a subassembly for mounting in the burner barrel of a fuel gas burner, the subassembly comprising the gas/air mixing tube, the deflector plate and the swirl generator.

In a further aspect, the invention provides a method of producing a relatively short flame emanating from the burner barrel of a gas-fired burner comprising the steps of supplying a flow of combustion air to the upstream end of the burner barrel; directing the fuel gas through a tubular gas conduit having a terminal end portion within the burner barrel and being substantially concentric with such barrel; directing a selected volume of the flow of combustion air through an annulus formed between the gas conduit and a gas/air mixing tube mounted concentrically around the gas conduit, the mixing tube extending a predetermined distance beyond the gas conduit to a downstream end; directing the remaining volume of the combustion air in the burner barrel through a second annulus formed between the mixing tube and the burner barrel, the remaining volume flowing through a swirl assembly mounted on the mixing tube in the second annulus just upstream from the downstream end of the mixing tube; deflecting the gas/air mixture at the downstream end of the mixing tube; and sweeping the deflected gas/air mixture away from the downstream side of the swirl assembly by means of a stream of air emanating from a gap formed between the swirl assembly and the mixing tube.

BEST MODE FOR CARRYING OUT THE INVENTION

Figure 1:
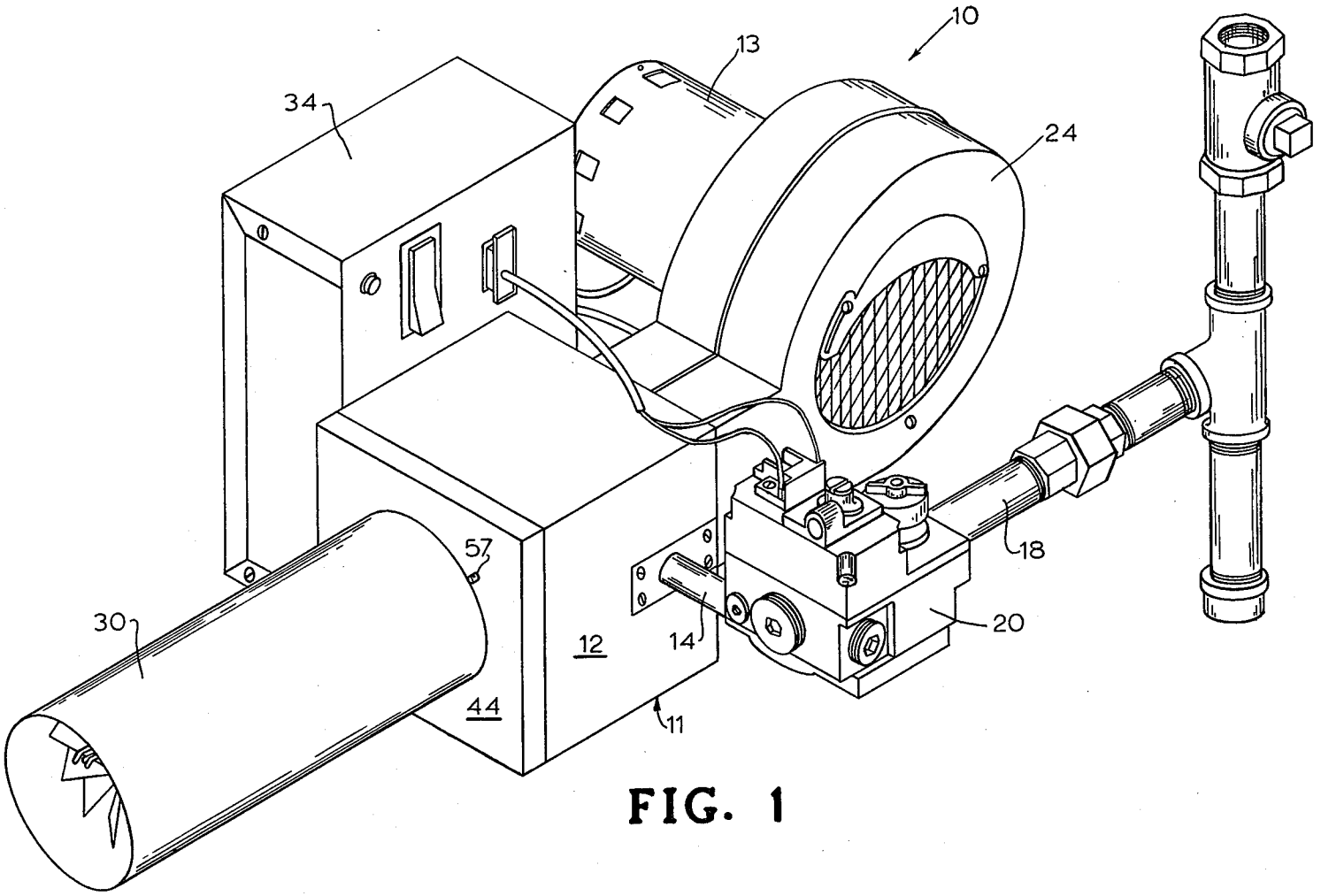
FIG. 1 is a pictorial view of a fuel gas burner constructed in accordance with the present invention.
Figures 2, 8:
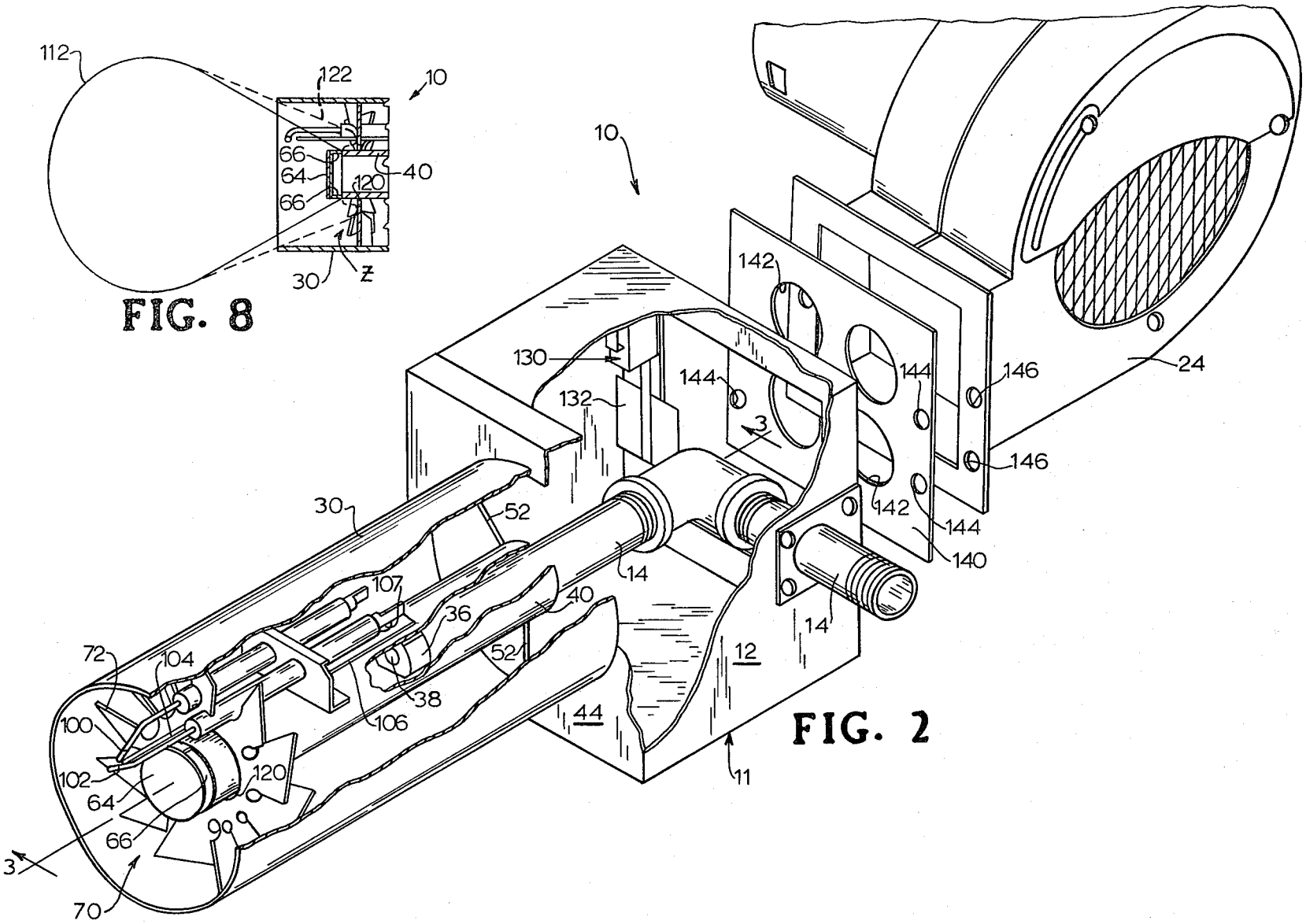
FIG. 2 is a fragmentary, exploded, pictorial view of portions of the burner illustrated in FIG. 1.
FIG. 8 is a side view of a portion of the burner of the instant invention illustrating the shape of the flame emanating therefrom.
Figure 3:
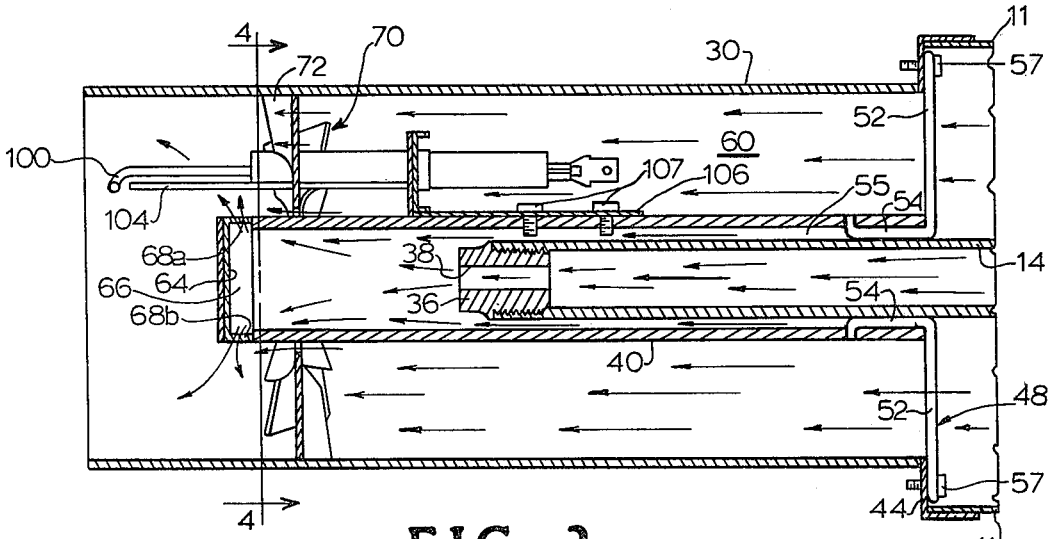
FIG. 3 is a fragmentary section view taken substantially along line 3—3 of FIG. 2.

Referring to the drawings, and particularly to FIGS. 1–3, there is illustrated a fuel-gas burner 10 adapted for mounting on a conventional furnace firebox. While the following description will discuss the use of the burner of the present invention in the conversion of an oil-fired furnace to a gas-fired furnace, it will be appreciated that the invention is not so limited since the burner of the invention may be used in new gas furnace designs, particularly where a short flame is desired.

Burner 10 includes a substantially box-shaped housing 11 which, at one of its side faces 12, receives a tubular gas supply conduit 14. Gas to conduit 14 is supplied from a main gas line 18 through a valve assembly 20. Valve assembly 20 includes a pressure regulator for reducing the line pressure to a desired pressure, typically three and one-half inches of water column and a solenoid valve (not shown) to control the gas supply to the burner.

Housing 11 also mounts the outlet from a squirrel cagetype blower 24 which is used to supply the combustion air for burning the gas introduced through conduit 14. Air from blower 24 is directed through housing 11 and into a burner barrel 30 which extends from side 44 of housing 11 opposite blower 24.

The fourth side of housing body 11 mounts a control box 34 (FIG. 1) for controlling the burner. It will be appreciated that the precise logic circuitry does not form a part of the present invention and that a Fenwal model 05–16 circuit box manufactured by Fenwal, Incorporated, Ashland, Mass., has been used satisfactorily in association with the burner of the invention.

Referring to FIG. 2, conduit 14 makes a 90° turn within body 11 and is directed along the center of burner barrel 30 to a point approximately midway along the length of barrel 30 where tube 14 terminates at a nozzle 36. Nozzle 36 is threadably received by the end portion of tube 14 and includes an aperture 38 of selected size for dispensing the desired volume of gas. According to the invention, it is contemplated that several nozzles having different size apertures may be provided so that the operator may select the appropriate one for the given heating requirements of the application.

A gas-air mixing tube 40 is centrally and fixedly secured within burner barrel 30 and receives the end portion of tube 14 and nozzle 36. Mixing tube 40 may be mounted to the inner wall surface of housing sidewall 44 by means of mounting braces 48. In the illustrated embodiment, mixing tube 40 is mounted with its upstream end substantially flush to the beginning of burner barrel 30 at body sidewall 44. Mounting braces 48 may take the form of small diameter metal rods which include main portions 52 secured at their ends to the body sidewall 44 by screws 57 or other suitable means and extension portions 54 extending at right angles to main portions 52 and projecting inwardly into tube 40. Extension portions 54 may be secured to the inner surface of tube 40 by spot welding or other suitable means, to secure the upstream end of tube 40 centrally within burner barrel 30. Extension portions 54 serve a second purpose in that they are adapted to slidingly contact conduit 14 to centrally locate conduit 14 within mixing tube 40 so that an annulus 55 of predetermined size is maintained between the two.

Annulus 55 provides a means for introducing a quantity of air into mixing tube 40 for mixing with the fuel gas exiting nozzle 36. The primary purpose of this mixture within tube 40 is to assure that the gas exiting from nozzle 36 at relatively low pressure is carried along to the combustion zone of the burner at sufficient pressure and velocity. It has been found that an air-to-gas mixture in mixing tube 40 of about 1:1 provides excellent results. The ratio can be increased by increasing the cross sectional area of the annulus 55 between conduit 14 and mixing tube 40.

It will be appreciated that the remaining air from the blower 24 not entering annulus 55 travels to the combustion zone through the outer annulus 60 formed between burner barrel 30 and tube 40. It has been found that a ratio of air in the outer annulus to gas in the mixing tube on the order of 14:1 provides good results.

Figure 5:
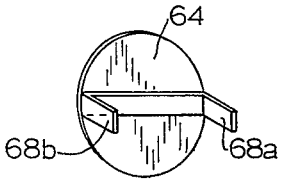
FIG. 5 is a pictorial view of the deflector located downstream from the nozzle and swirl blades.

The downstream end of mixing tube 40 mounts a disc-shaped gas deflector plate 64 which is adapted to direct the air/gas mixture through an opening 66 formed between plate 64 and the end of tube 40. As best shown in FIGS. 2 and 5, plate 64 may be suitably mounted by means of inwardly turned tabs 68*a*, 68*b* which may be secured by spot welding, or the like, to the downstream end of tube 40.

The deflection of the air/gas mixture by plate 64 serves to direct the air/gas mixture to the desired area in front of a swirl generator 70. Generator 70 includes a plurality (twelve illustrated) of swirl inducing blades 72 which are secured to the exterior of mixing tube 40 proximate the downstream end of such tube, but upstream from deflector plate 64. The outer extremities of blades 72 form a circle having a diameter only slightly smaller than the inside diameter of barrel 30 so that tube 40 with its attached deflector plate 64 and swirl generator 70 may be slidingly inserted as a subassembly into barrel 30 prior to securement to the barrel by means of mounting braces 48.

Referring to FIGS. 4 and 6–8, blades 72 of generator 70 may be formed from a sheet metal plate 80. An opening 82 sized larger than the outside diameter of mixing tube 40 is formed in plate 80. Opening 82 may include support tabs 84, three shown, which are bent back 90° from the plane of plate 80 to form securement faces for securement of generator 70 to tube 40 by spot welding, or other suitable means. The individual blades 72 are defined by stamping radial cuts 88 in plate 80. To facilitate the bending of the blades out of the plane of plate 80, each cut 88 may terminate at its inward end in a small circular cutout 90. The punching operation also includes the formation of circular openings 92, 94, 96 for receiving starter electrodes 100, 102 and flame sensor 104, respectively, discussed below. Following the punching operation, blades 72 are bent to an angle X which, in operation of burner 10, is the angle between the face of the blades and the path of combustion air flowing through barrel 30. While angle X must be less than 90°, it has been found that the disposition of blades 12 at an angle X between 45° to 60° is ideal.

Figure 6:
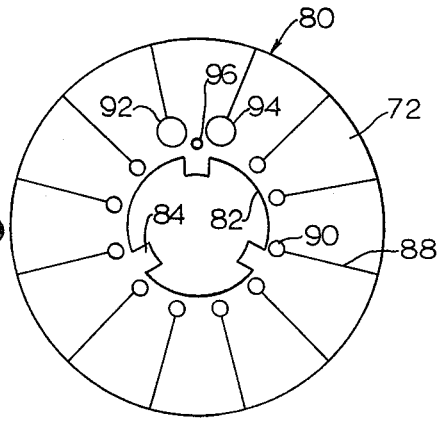
FIG. 6 is a front view of the workpiece from which the swirl blades are formed.
Figure 4:
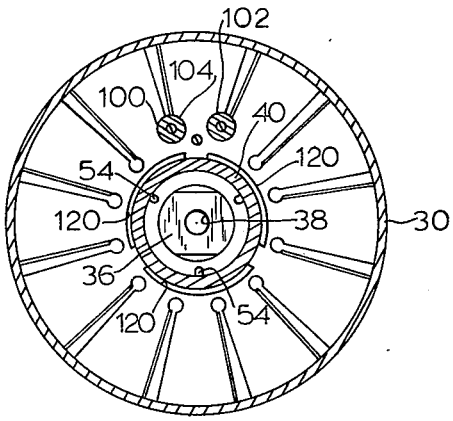
FIG. 4 is an enlarged section view taken substantially along line 4—4 of FIG. 3.
Figure 7:
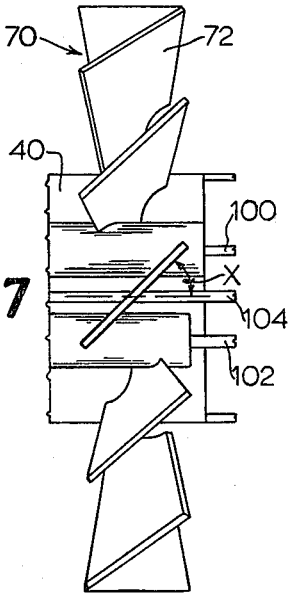
FIG. 7 is a side view of the swirl blade assembly as mounted on the tubular gas supply conduit and illustrating the opposed electrodes and temperature sensor.

Referring to FIG. 8, a short, fan-shaped flame 112 produced by burner 10 is shown in solid lines emanating from the opening 66 between the end of tube 40 and deflector plate 64. Preferably, flame 112 fans out from tube 40 into the space beyond barrel 30 so that the barrel is not subjected to the flame. As explained below, the forcing of flame 112 out of barrel 30 is accomplished by a small annular gap 120 (FIG. 4) on the order of $\frac{3}{8}$–$\frac{1}{4}$ inch formed between tube 40 and the bases of blades 72. The size of annular gap 120 is determined by the size of opening 82 in plate 80 (FIG. 6). As shown in dashed lines in FIG. 8, it has been found that without employing gap 120 the flame may include a flame portion 122 which is substantially inside barrel 30, resulting in undesirable heating of barrel 30 and, by conduction, heating of other parts of burner 10.

With reference to FIG. 8, the cooperation between the gas/air premixing in tube 40 and the function of annular gap 120 will be explained. If there were no gap 120, there would be a low pressure in the zone Z located around the mixing tube 40 just downstream from the swirl blades. The low pressure in zone Z would tend to draw the gas/air mixture emanating from opening 66, resulting in undesirable combustion in zone Z as shown by a flame pattern 122. Thus, without gap 120 mixing tube 40 would serve the desirable function of delivering the gas/air mixture at increased velocity and pressure, but would result in an undesirable flame pattern. The incorporation of gap 120 into the burner design eliminated low pressure in zone Z so that the gas/air mixture from opening 66 is not drawn into zone Z, resulting in the desired flame pattern 112.

Not only is gap 120 desirable for the proper untilization of mixing tube 40 but the converse is also true. If gap 120 were employed without utilizing premixing tube 40, the increased pressure in zone Z caused by air flowing through gap 120 would make it difficult for the gas to steadily flow through opening 66 due to its inherent low velocity and pressure. Thus, the increased velocity and pressure created by mixing tube 40 will allow the gas/air mixture to flow out of opening 66 even with the elevated pressure in zone Z. It can be seen that mixing tube 40 and annular gap 120 work together, in conjunction with swirl generator 70, to produce the desired flame pattern.

Referring to FIG. 2, there is shown a sail switch 130 including a sail 132 which is positioned in the flow of air from blower 24. Switch 130 is adapted to shut down the gas supply at any time it senses a lack of sufficient air entering housing 11.

In situations where a low volume of air is needed, for example in burning fuel gases of high Btu content such as propane or butane, a baffle plate 140 having openings 142 may be positioned between blower 24 and housing 11 to reduce the flow of combustion air. Baffle 140 may be provided with apertures 144 for aligning with apertures 146 on blower 24 so that the baffle may be secured by threaded fasteners (not shown) securing blower 24 to housing 11. When baffle 140 is incorporated into the burner, it is preferable that sail 132 of switch 130 be centered on one of the baffle openings 142 in order to concentrate a sufficient flow of air on the sail.

Ignition of the air/gas mixture is accomplished by an electrode assembly including electrodes 100, 102 and sensor 104 which are held in position by an electrode mount 106. Mount 106 is secured to tube 40 by screws 107 (FIG. 3). By an appropriate signal from the logic circuitry a spark is formed in the gap between electrodes 100, 102. Sensor 104 senses the temperature in the flame area and, in the manner known in the art, serves to stop the spark when the flame is burning.

In operation, fuel gas from supply line 18 enters conduit 14 through valve assembly 20. Gas exiting nozzle 36 is mixed with approximately an equal volume of combustion air in mixing tube 40 and carried to the end of the burner barrel 30 where the gas is subjected to the violent, turbulent action of the remaining combustion air passing through swirl generator 70. Electrodes 100, 102 ignite the mixture. The flame is directed away from the area enveloped by barrel 30 by means of air passing through annular gap 120.

While the present invention has been described in connection with a preferred embodiment, those skilled in the art will appreciate that numerous changes and modifications can be made to the described structure without departing from the true spirit and scope of the invention.

I claim:

1. A method of producing a relatively short flame emanating from the burner barrel of a gas-fired burner comprising the steps of:

(a) supplying a flow of combustion air to the upstream end of the burner barrel;

(b) directing fuel gas through a tubular gas conduit having a straight terminal end portion within and concentric with the burner barrel and a discharge end located upstream from the downstream end of the burner barrel;

(c) directing a selected minor portion of the flow of combustion air through a first annulus formed between the gas conduit and a gas/air mixing tube mounted within said burner barrel concentrically around the gas conduit and extending a predetermined distance beyond the gas conduit to a downstream end located upstream from the downstream end of the burner barrel and downstream from the discharge end of said gas conduit and allowing said selected minor portion of combustion air and fuel gas exiting the discharge end of said terminal end portion of said tubular gas conduit to mix within said mixing tube prior to exiting therefrom;

(d) directing the remaining and major portion of the combustion air in the burner barrel through an second annulus formed between the mixing tube and the burner barrel, and through a swirl assembly mounted on the mixing tube in the second annulus upstream from and proximate the downstream end of the mixing tube;

(e) deflecting the gas/air mixture exiting the downstream end of the mixing tube with a deflector plate providing a flat deflection surface in a plane substantially perpendicular to the axis of said mixing tube so as to intermix such gas/air mixture with said remaining and major portion of combustion air passing through said swirl assembly at a location within said burner barrel forward of the downstream end of said mixing tube;

(f) sweeping the deflected gas/air mixture away from the downstream side of the swirl assembly by means of a stream of air emanating from a gap formed between the swirl assembly and the mixing tube; and (g) igniting the gas/air mixture flowing from said swirl assembly and sustaining the base of the flame produced therefrom at a location within the downstream end of said barrel.

2. In a fuel gas burner having a flowing source of combustion air, in combination:

(a) a tubular gas supply conduit having an upstream intake end for connection to a source of fuel gas and a downstream discharge end in a straight end portion;

(b) a nozzle threadably secured in the said straight end portion at said discharge end of said conduit;

(c) a cylindrical gas/air mixing tube concentric with and surrounding said straight end portion of said gas conduit and extending downstream a predetermined distance beyond said nozzle, said mixing tube and gas conduit defining:

(i) therebetween and for the length of said surrounded straight end portion of said conduit a first annulus for receiving a minor portion of the combustion air emanating from the source thereof; and (ii) forward of said first annulus between said nozzle and the downstream end of said mixing tube a first chamber for mixing the combustion air received through said first annulus with gas exiting said nozzle whereby to establish a gas/air mixture confined within and flowing to the downstream end of said mixing tube;

(d) a circular deflector plate positioned outwardly from the downstream end of and being of substantially the same diameter as the inner diameter of said mixing tube, said deflector plate providing a flat deflection surface in a plane substantially perpendicular to the axis of said mixing tube and in sufficient proximity to the downstream end of said mixing tube such that the flow of the air/gas mixture exiting said mixing tube first chamber is caused to impinge thereon and be deflected in a direction parallel to said plane;

(e) a cylindrical burner barrel concentric with and surrounding said mixing tube and extending downstream a predetermined distance beyond and surrounding said deflector plate, said burner barrel having an upstream intake end for connection to the source of combustion air and a downstream discharge end and defining:

(i) between said burner barrel and said mixing tube for the length thereof, a second outer annulus for carrying the remainder and major portion of the combustion air not carried by said first annulus; and (ii) forward of said second annulus between said deflector plate and the downstream end of said burner barrel a second mixing and ignition chamber;

(f) a swirl generator disposed in said second outer annulus upstream from said deflector plate and proximate the downstream end of said mixing tube and having a plurality of swirl blades surrounding and extending radially from said mixing tube and disposed at an angle X less than 90° to the path of combustion air flowing in the second outer annulus to generate turbulence in such air prior to its mixture with the gas/air mix emanating from said mixing tube at said deflector plate and being further characterized by:

(i) the perimeter of the swirl blades being sized to engage the inner surface of the burner barrel and thereby hold the downstream end of the mixing tube in place; and (ii) an annular gap being provided at the base of the swirl generator surrounding said mixing tube to provide a stream of combustion air for sweeping the gas/air mixture emanating from the mixing tube at said deflector plate away from the downstream side of the swirl blades; and (g) gas ignition means mounted within said burner tube downstream from said deflector plate and in said second mixing and ignition chamber.

3. In a fuel gas burner as claimed in claim 2 including a plurality of mounting braces for securing the upstream end of said mixing tube in place, each brace comprising a remote end secured within the mixing tube and a bracing end for securement to a fixed burner element, the remote ends of said mounting braces being sized so as to slidably engage the gas conduit within the mixing tube to uniformly space the mixing tube and the gas conduit in a concentric fashion.

* * * * *